US007581704B1

(12) United States Patent
Pugsley

(10) Patent No.: US 7,581,704 B1
(45) Date of Patent: Sep. 1, 2009

(54) CUPHOLDER APPARATUS

(76) Inventor: Dennis D. Pugsley, 13021 N. 18th Dr., Phoenix, AZ (US) 85029

( * ) Notice: Subject to any disclaimer, the term of this patent is extended or adjusted under 35 U.S.C. 154(b) by 0 days.

(21) Appl. No.: 12/252,257

(22) Filed: Oct. 15, 2008

(51) Int. Cl.
*A47K 1/08* (2006.01)

(52) U.S. Cl. ..... 248/311.2; 220/737; 220/742; 220/756

(58) Field of Classification Search ..... 248/311.2; 220/756, 737, 769, 742; 206/459.1
See application file for complete search history.

(56) References Cited

U.S. PATENT DOCUMENTS

| | | | | | |
|---|---|---|---|---|---|
| 2,532,244 | A | * | 11/1950 | Pasmore | 220/278 |
| 3,847,311 | A | * | 11/1974 | Flores et al. | 222/473 |
| 4,120,073 | A | | 10/1978 | Studebaker | |
| 4,720,023 | A | | 1/1988 | Jeff | |
| 4,723,801 | A | | 2/1988 | Musumeci et al. | |
| 4,966,303 | A | | 10/1990 | Jones | |
| 4,993,675 | A | * | 2/1991 | Walker | 248/311.2 |
| 5,203,471 | A | * | 4/1993 | Widman | 220/755 |
| 5,492,246 | A | | 2/1996 | BAiley | |
| D395,825 | S | | 7/1998 | Freitas | |
| D449,968 | S | | 11/2001 | Reed | |
| 2004/0135049 | A1 | * | 7/2004 | Kent-Fawkes | 248/311.2 |
| 2005/0184078 | A1 | * | 8/2005 | Oas | 220/756 |

* cited by examiner

*Primary Examiner*—Ramon O Ramirez
(74) *Attorney, Agent, or Firm*—Crossley Patent Law; Mark A. Crossley

(57) ABSTRACT

The cupholder apparatus removably receives a cup of liquid, typically beverage. The apparatus separates a user's hand from the cup, thereby providing protection from temperature extremes of the cup's liquid and the cup. The apparatus is especially effective with disposable cups and is provided in more than one embodiment. Both embodiments provide a flattened tapered ring to removably receive a cup, especially a tapered one. The first apparatus embodiment has a handle with a clip which movably extends over the cup. The clip provides spring-loaded downward pressure atop the cup, thereby providing cup retention within the ring. Button depression releases the clip from atop the cup, thereby releasing the cup for removal. The second embodiment provides a handle with orifice and a loop with orifice on the opposite ring side, an elastic band selectively disposed over a cup lid and a cup within the ring.

9 Claims, 7 Drawing Sheets

CUPHOLDER APPARATUS

BACKGROUND OF THE INVENTION

Drinks, whether hot or cold, are often served in disposable cups, especially drinks served to go. A problem has always existed in that hot or cold drinks are not only uncomfortable to the touch, but can be harmful. Even if cups, whether disposable or not, attempt to insulate a user against touch, temperature extremes typically migrate though the insulation. Coffee houses have offered cardboard style insulators which, while helpful, are still not totally effective. What has been needed is a handle apparatus which provides a handle which isolates a user from the cup. The handle, further, should be as lightweight and compact as possible, thereby saving space whether in use or not, and also thereby ensuring against toppling of a cup when the cup is placed atop a surface. An added benefit would be a positive means for retaining the cup within the holder. The present apparatus fulfills these needs.

FIELD OF THE INVENTION

The cupholder apparatus relates to cupholders and more especially to a compact lightweight cupholder which disposes a user's hand away from the cup and which provides for positive cup retention within the holder.

SUMMARY OF THE INVENTION

The general purpose of the cupholder apparatus, described subsequently in greater detail, is to provide a cupholder apparatus which has many novel features that result in an improved cupholder apparatus which is not anticipated, rendered obvious, suggested, or even implied by prior art, either alone or in combination thereof.

To attain this, the cupholder apparatus is a compact lightweight apparatus which removably receives a cup of liquid, typically beverage. The apparatus separates a user's hand from the cup, thereby providing protection from temperature extremes of the cup's liquid and the cup. The apparatus is especially effective with disposable cups. The apparatus is provided in more than one embodiment. Both embodiments provide a flattened tapered ring to removably receive a cup, as most cups are tapered. The first apparatus embodiment further comprises a handle with a clip which movably extends over the cup. The clip provides spring-loaded downward pressure atop the cup, thereby providing cup retention within the ring. Button depression releases the clip from atop the cup, thereby releasing the cup for removal.

The second embodiment of the apparatus provides an elastic band captured within the handle and within a loop on the ring opposite the handle. The elastic band is selectively placed atop a lid of a cup within the ring, thereby selectively retaining the lid on the cup and the cup within the ring.

Thus has been broadly outlined the more important features of the improved cupholder apparatus so that the detailed description thereof that follows may be better understood and in order that the present contribution to the art may be better appreciated.

An object of the cupholder apparatus is to dispose a user's hand away from a cup.

An added object of the cupholder apparatus is to positively and selectively retain a cup within the apparatus.

Another object of the cupholder apparatus is to be compact.

A further object of the cupholder apparatus is to be lightweight.

And, an object of the cupholder apparatus is to prevent damage to a disposable cup.

These together with additional objects, features and advantages of the improved cupholder apparatus will be readily apparent to those of ordinary skill in the art upon reading the following detailed description of presently preferred, but nonetheless illustrative, embodiments of the improved cupholder apparatus when taken in conjunction with the accompanying drawings.

In this respect, before explaining the current embodiments of the improved cupholder apparatus in detail, it is to be understood that the cupholder apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved cupholder apparatus. It is therefore important that the claims be regarded as including such equivalent constructions insofar as they do not depart from the spirit and scope of the cupholder apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the cupholder apparatus generally designated by the reference number 10 will be described.

Figure 1:
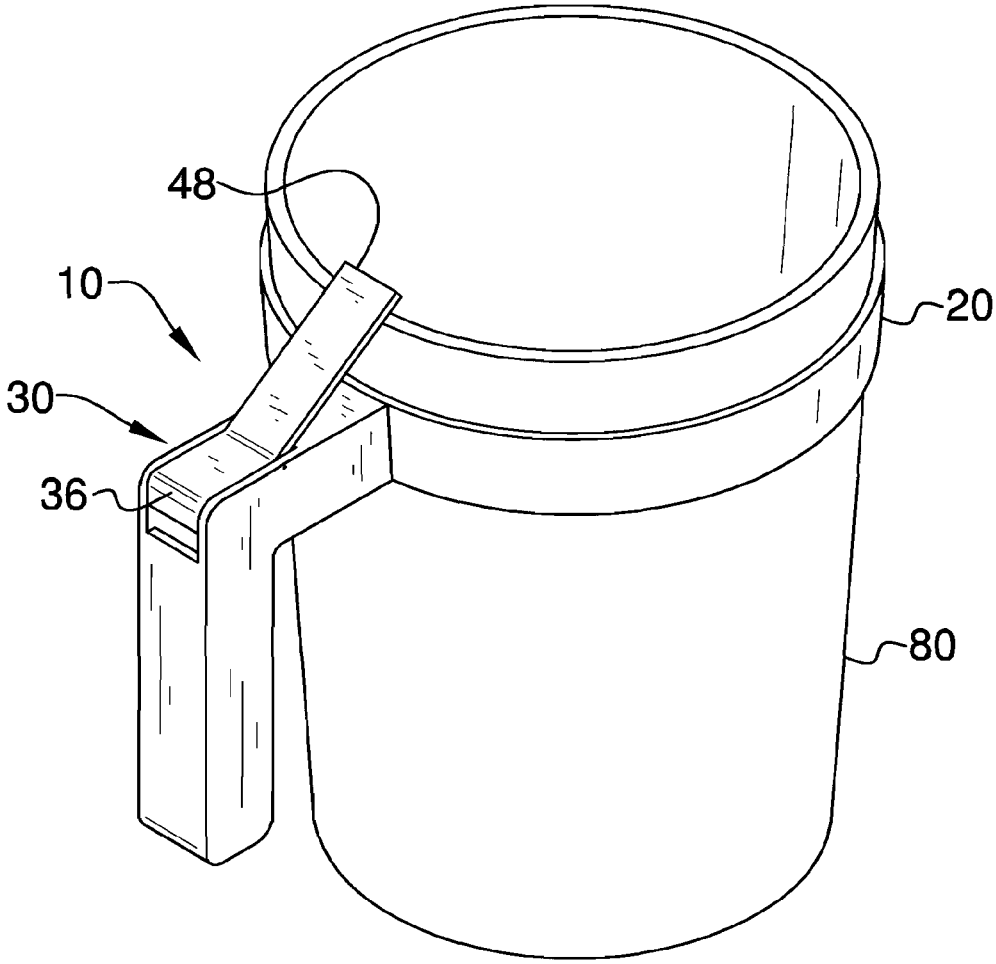
FIG. 1 is a perspective view of the apparatus in use.

Referring to FIG. 1, the cupholder apparatus 10 provides for holding an existing cup 80 without having to touch the cup 80. The flattened ring 20 is tapered to best receive the tapered cup 80, without cup 80 damage. The flattened, tapered ring 20 is especially important with regard to many disposable cups 80 which are easily dented and punctured. The flattened clip 48 selectively retains the cup 80 within the ring 20. The flattened clip 48 design is important in that no rim damage to fragile cups 80 can occur with the clip's 48 pressure.

Figure 2:
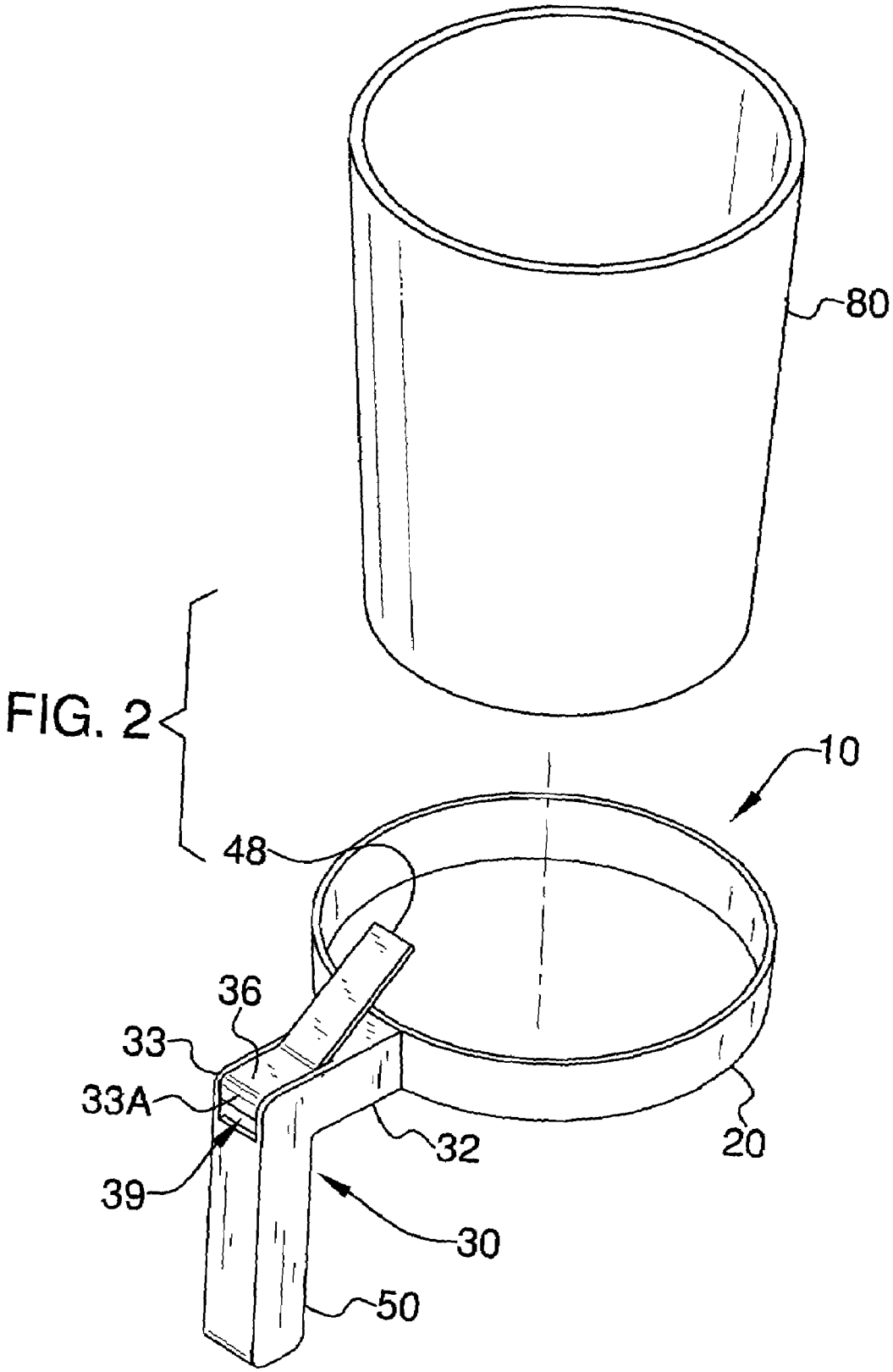
FIG. 2 is a perspective view of the apparatus with cup removed.
Figure 3:
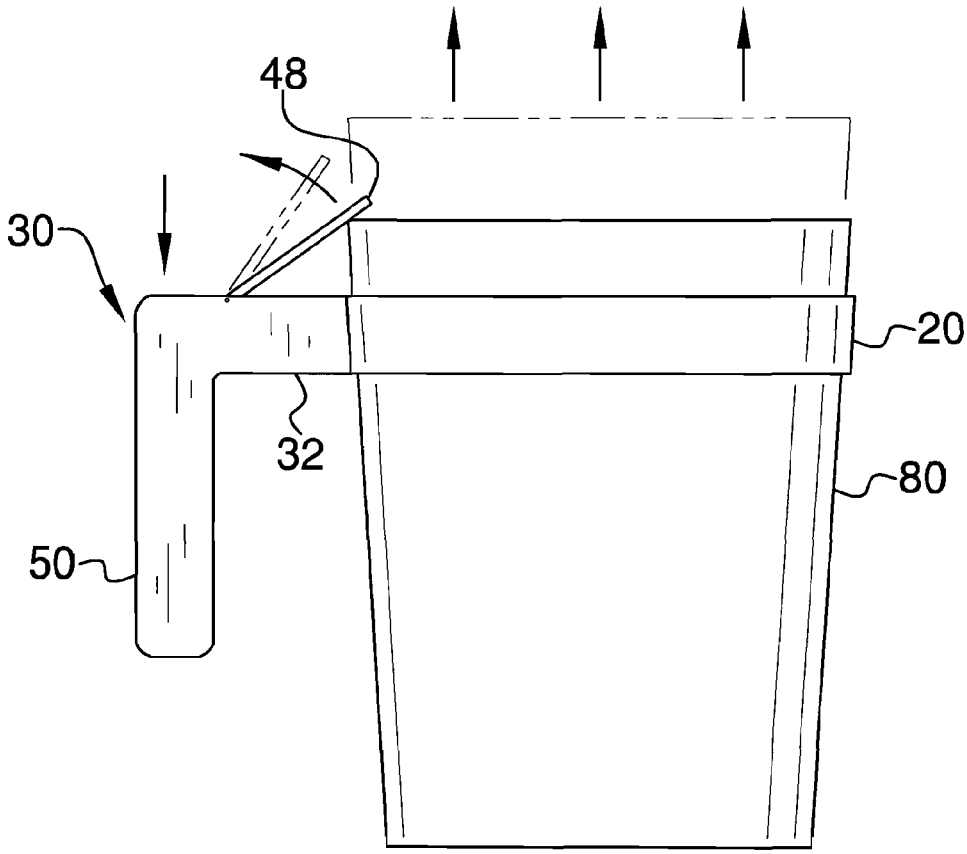
FIG. 3 is a lateral elevation view of the apparatus illustrating cup elevation for cup removal.

Referring to FIGS. 2 and 3, the cup 80 is selectively removed from and inserted into the ring 20. The handle 30 button 36 is flattened for use comfort. The button 36 must be depressed in order to insert and remove a cup 80 from the ring 20. The handle 30 partially comprises the horizontal member 32 which extends outwardly from the ring 20. The horizontal member 32 adjoins the vertical member 50 at the rounded bend 33. The rounded bend 33 adds to user comfort.

Figure 4:
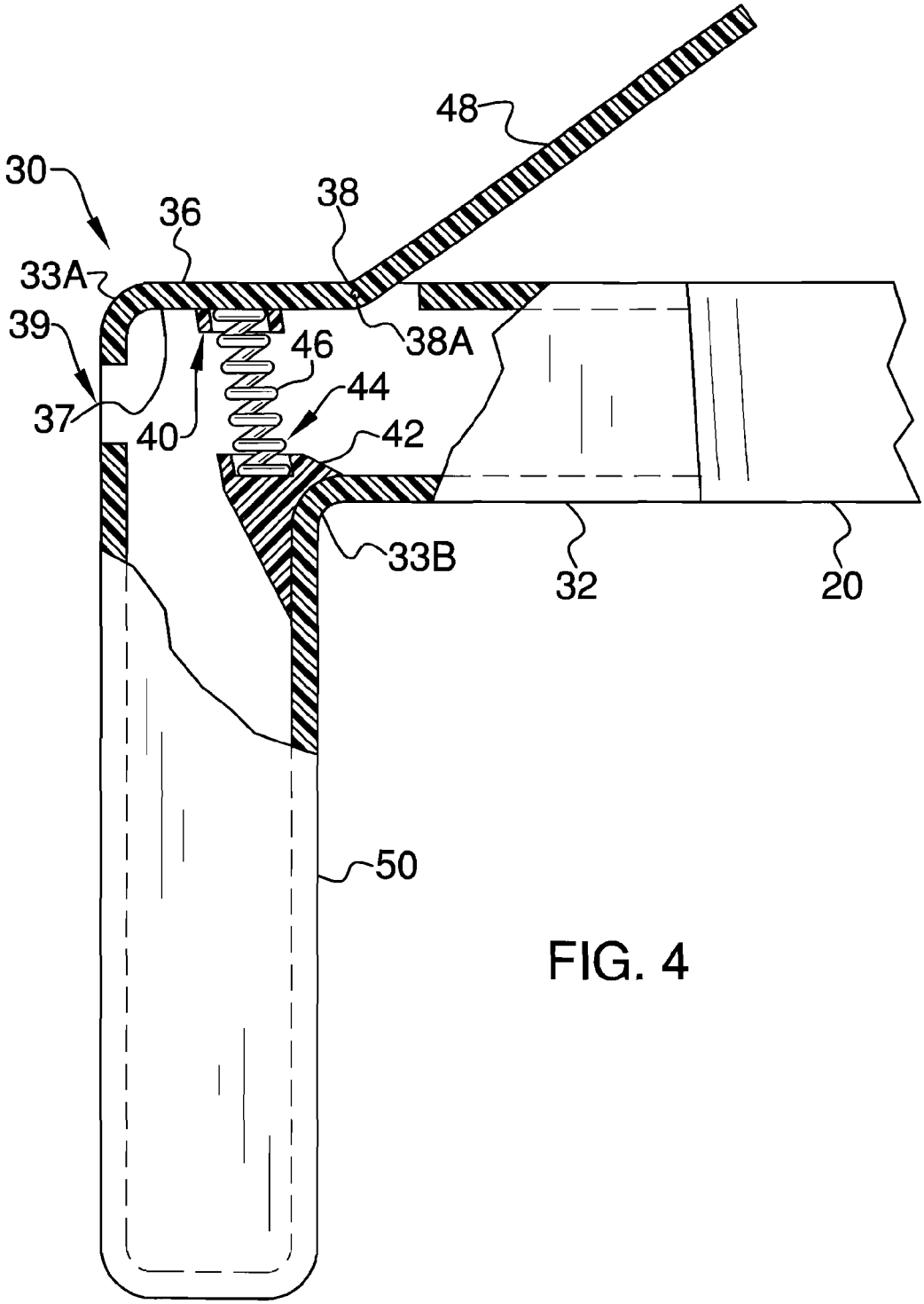
FIG. 4 is a lateral cross sectional view of the handle, the clip in a position for retaining a cup.
Figure 5:
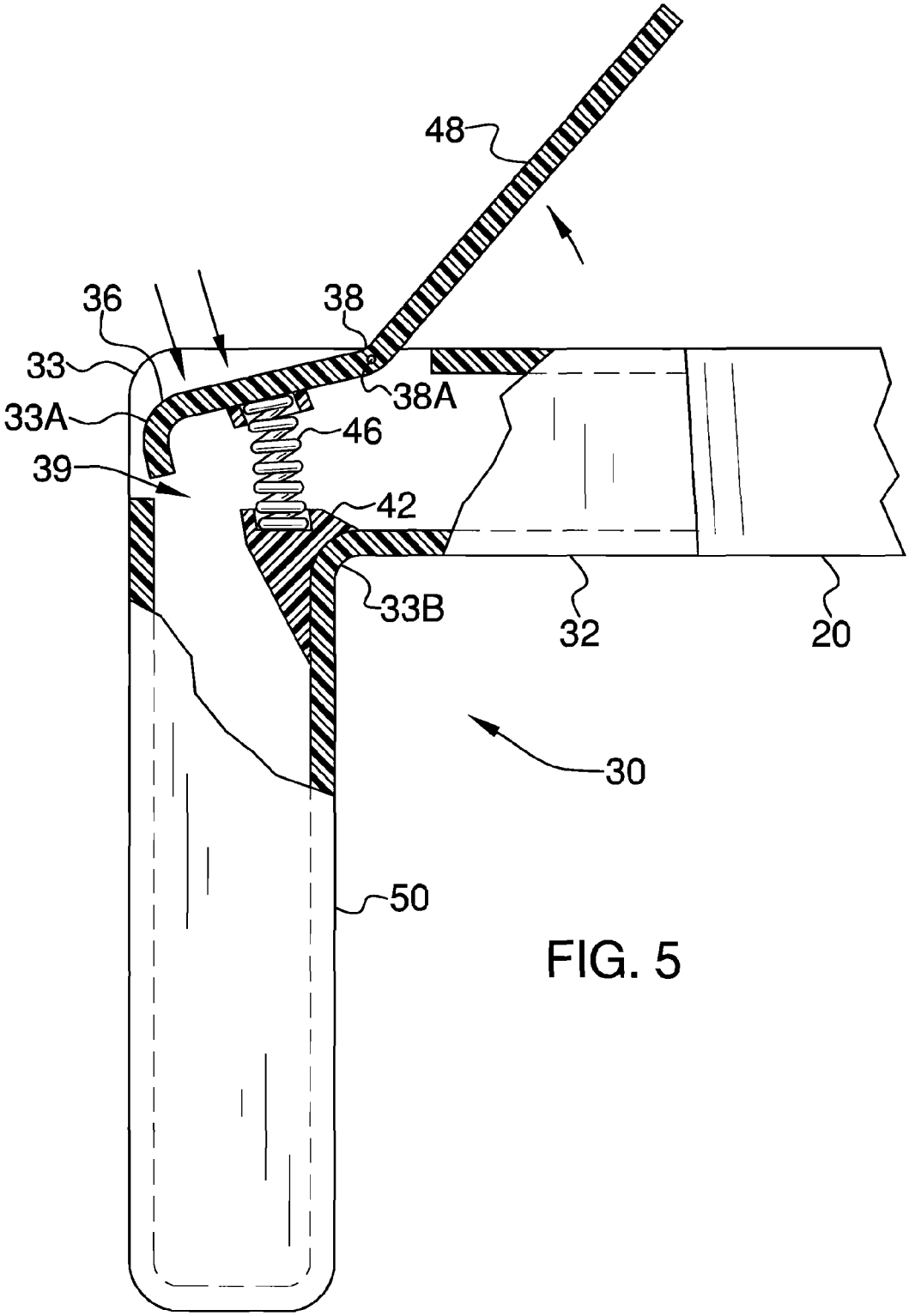
FIG. 5 is a lateral cross sectional view of the handle, button depressed and clip elevated.

Referring to FIGS. 4, and 5, the rounded bend 33 of the handle 30 further comprises the lower bend **33*b*. A hollow 39 is disposed within a portion of the horizontal member 32, the rounded bend 33, and a portion of the vertical member 50. The flattened button 36 is movably disposed within the hollow 39. The button 36 has a button rounded edge 33***a* movably coincidentally coplanar with the rounded bend 33, both for aesthetic appeal and user comfort. The pivot 38*a* connects the button 36 to the horizontal member 32. The upward angle 38 is connected to the button 36 at the pivot 38*a*. The upward angle 38 is affixed to the clip 48 which extends from the pivot 38*a* toward and movably over the ring 20. The clip 48 is movably disposed atop the existing cup 80. The upper spring seat 40 is disposed on the button 36 bottom side 37. The spring base 42 is disposed within the handle 30 hollow 39. The spring base 42 is disposed internal to the lower bend 33*b*. The lower spring seat 44 is affixed atop the spring base 42. The compression spring 46 is captured between the upper spring seat 40 and the lower spring seat 44. The spring 46 thereby resists downward pivotal button 36 pressure and, in turn, provides pressure against the top of a cup 80 with the button 36 released.

Figure 6:
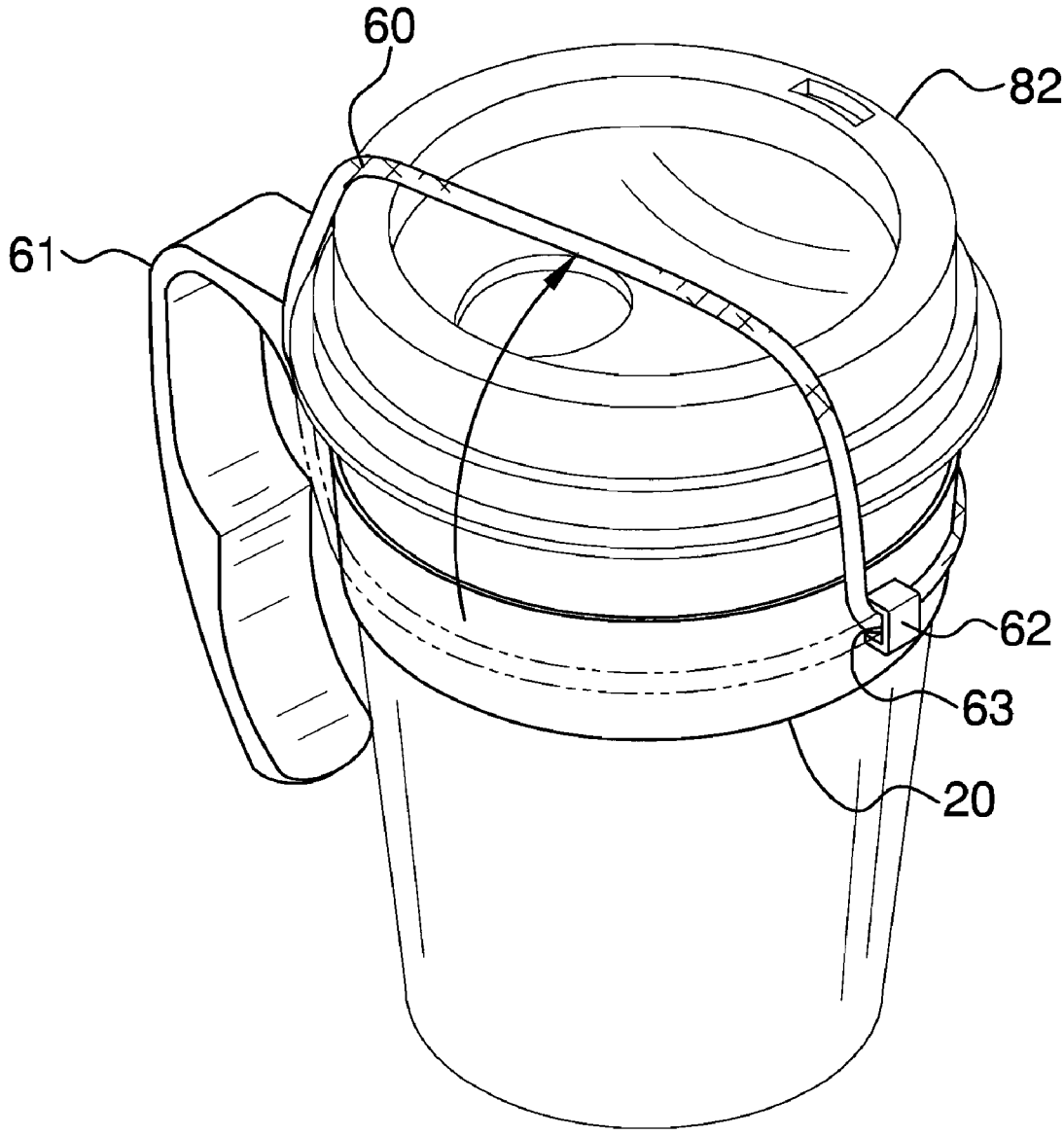
FIG. 6 is a perspective view of the alternate embodiment of the apparatus in use with a cup and lid.
Figure 7:
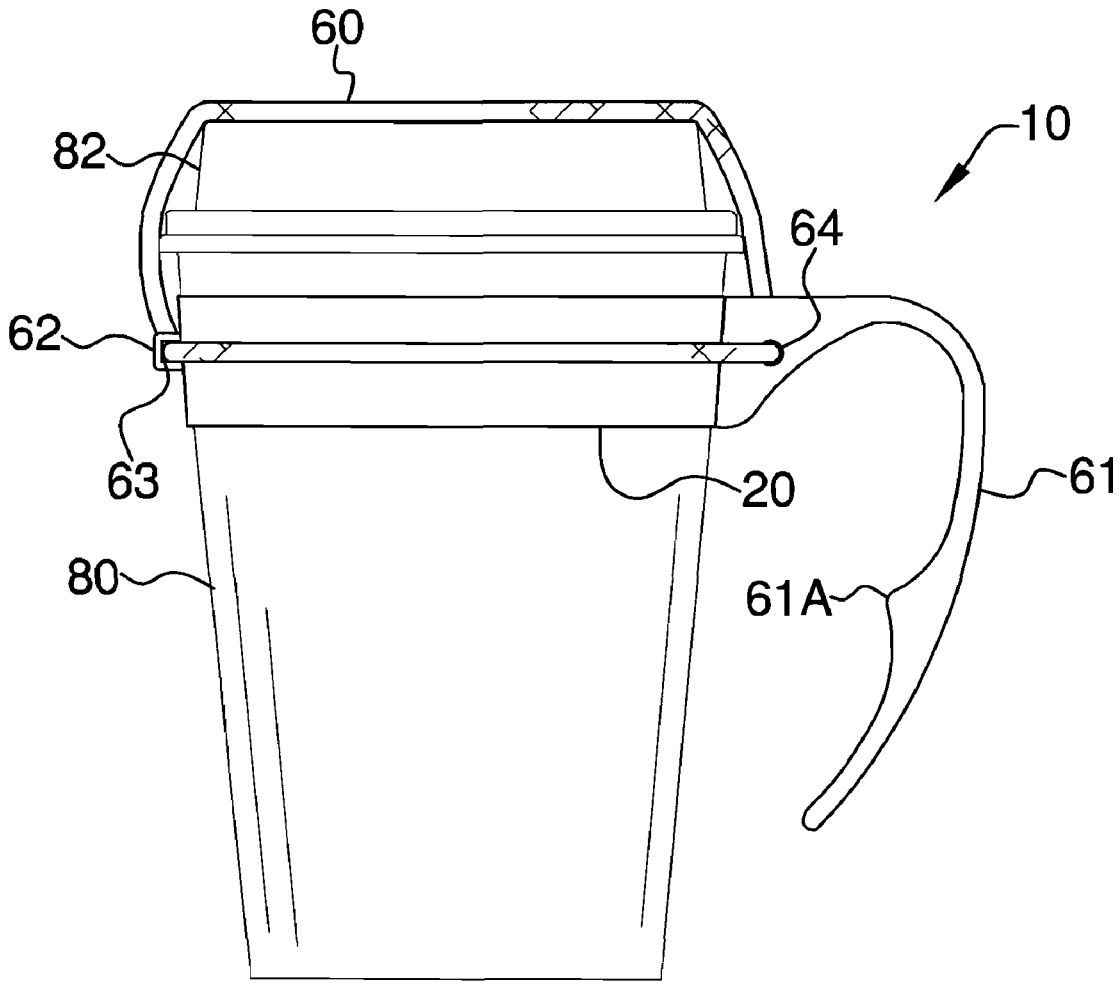
FIG. 7 is a lateral elevation view of the alternate embodiment of the apparatus of FIG. 6.

Referring to FIGS. 6 and 7, the alternate embodiment of the apparatus 10 provides for selectively retaining a cup 80 within the flattened ring 20. The contoured handle 61 is affixed outwardly to the ring 20. A finger grip 61*a* is disposed on the contoured handle 61. A handle orifice 64 is disposed within the contoured handle 61. The handle orifice 64 is proximal to the ring 20. The loop 62 is disposed on the ring 20 opposite the contoured handle 61. The loop orifice 63 is disposed within the loop 62. The elastic band 60 is disposed within the handle orifice 64 and the loop orifice 63. The elastic band 60 is selectively and movably disposed atop the existing lid 82 of the existing cup 80, thereby retaining the cup 80 within the ring 20 and the lid 82 on the cup 80.

With respect to the above description then, it is to be realized that the optimum dimensional relationships for the parts of the cupholder apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the cupholder apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the cupholder apparatus may be used.

Therefore, the foregoing is considered as illustrative only of the principles of the cupholder apparatus. Further, since numerous modifications and changes will readily occur to those skilled in the art, it is not desired to limit the cupholder apparatus to the exact construction and operation shown and described, and accordingly, all suitable modifications and equivalents may be resorted to, falling within the scope of the cupholder apparatus.

What is claimed is:

1. A cupholder apparatus, comprising:

a flattened tapered ring selectively receiving an existing cup;

a handle affixed to the ring, the handle comprising:

a horizontal member extended outwardly from the ring;

a vertical member perpendicularly connected to the horizontal member;

a hollow within a portion of the horizontal member and a portion of the vertical member;

a button movably disposed within the hollow;

a pivot connecting the button to the horizontal member;

an upward angle connected to the button, the upward angle disposed at the pivot;

a clip extended from the upward angle toward and over the ring, the clip movably disposed atop the cup, the clip selectively retaining the cup within the ring;

means for resisting downward pivotal pressure on the button.

2. The apparatus according to claim 1 wherein the button further comprises a flattened button.

3. The apparatus according to claim 2 wherein the clip further comprises a flattened clip.

4. The apparatus according to claim 3 wherein the means for resisting downward pivotal pressure on the button further comprises a compressing spring.

5. The apparatus according to claim 2 wherein the means for resisting downward pivotal pressure on the button further comprises a compression spring.

6. The apparatus according to claim 1 wherein the clip further comprises a flattened clip.

7. The apparatus according to claim 6 wherein the means for resisting downward pivotal pressure on the button further comprises a compression spring.

8. The apparatus according to claim 1 wherein the means for resisting downward pivotal pressure on the button further comprises a compression spring.

9. A cupholder apparatus, comprising:

a flattened tapered ring selectively receiving an existing cup;

a handle affixed to the ring, the handle comprising:

a horizontal member extended outwardly from the ring;

a vertical member perpendicularly connected to the horizontal member via a rounded bend, the rounded bend further comprising a lower bend;

a hollow within a portion of the horizontal member, the rounded bend, and a portion of the vertical member;

a flattened button movably disposed within the hollow, the button having a button rounded edge movably coincidentally coplanar with the rounded bend;

a pivot connecting the button to the horizontal member;

an upward angle connected to the button, the upward angle disposed at the pivot;

a flattened clip extended from the upward angle toward and over the ring, the clip movably disposed atop the cup;

an upper spring seat disposed on a bottom side of the button;

a spring base disposed within the handle hollow, the spring base disposed internal to the lower bend;

a lower spring seat affixed atop the spring base;

a compression spring captured between the upper spring seat and lower spring seat, the spring resisting downward pressure on the button, the spring providing pressure against a top of a cup 80 with button 36 release.

* * * * *